US010236603B2

(12) United States Patent
Goto

(10) Patent No.: US 10,236,603 B2
(45) Date of Patent: Mar. 19, 2019

(54) PRESS-FIT TERMINAL

(71) Applicant: Sumitomo Wiring Systems, Ltd., Yokkaichi, Mie (JP)

(72) Inventor: Hideki Goto, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/567,422

(22) PCT Filed: Mar. 9, 2016

(86) PCT No.: PCT/JP2016/057355
§ 371 (c)(1),
(2) Date: Oct. 18, 2017

(87) PCT Pub. No.: WO2016/170865
PCT Pub. Date: Oct. 27, 2016

(65) Prior Publication Data

US 2018/0123267 A1 May 3, 2018

(30) Foreign Application Priority Data

Apr. 22, 2015 (JP) ..... 2015-087643

(51) Int. Cl.
*H01R 12/58* (2011.01)
*H01B 5/02* (2006.01)
(Continued)

(52) U.S. Cl.
CPC ..... *H01R 12/585* (2013.01); *H01B 5/02* (2013.01); *H01R 13/03* (2013.01); *H01R 43/16* (2013.01); *H01R 13/035* (2013.01)

(58) Field of Classification Search
CPC ..... H01R 12/585; H01R 13/41; H01R 12/58
(Continued)

(56) References Cited

U.S. PATENT DOCUMENTS 3,328,749 A * 6/1967 Kukla ..... H01R 9/16 439/389
3,670,294 A * 6/1972 Johnson ..... H01R 13/41 439/697
(Continued)

FOREIGN PATENT DOCUMENTS

JP S62-005575 A 1/1987
JP H10-241760 A 9/1998
(Continued)

OTHER PUBLICATIONS

Search Report for PCT/JP2016/057355, dated May 24, 2016.

*Primary Examiner* — Ross N Gushi
(74) *Attorney, Agent, or Firm* — Honigman LLP

(57) ABSTRACT

Provided is a press-fit terminal configured to secure a warp of press-contact portions and reduce insertion force required to insert the press-contact portion into the through hole, without increasing the number of components and manufacturing costs. In a press-fit terminal one end portion of a Rod-Shaped Metal Member ("RSMM") is provided with press-contact portions configured to be press-fitted into a through hole of a printed board and electrically connected to a conductor, and the other end portion of the rod-shaped metal member includes a connection portion configured to be connected to a partner member, the one end portion of the RSMM has: squashed portions; and the press-contact portions that protrude outward from the squashed portions, and each press-contact portion is configured to deform in a circumferential direction of the RSMM due to contact pressure applied when the press-contact portions are pressed against the through hole.

5 Claims, 8 Drawing Sheets

(51) Int. Cl.
*H01R 13/03* (2006.01)
*H01R 43/16* (2006.01)

(58) Field of Classification Search
USPC ..... 439/82, 84, 567
See application file for complete search history.

(56) References Cited

U.S. PATENT DOCUMENTS 3,824,554 A * 7/1974 Shoholm ..... H01R 12/585 439/873
3,862,792 A * 1/1975 Jayne ..... H01R 13/111 439/733.1
3,997,237 A * 12/1976 White ..... H01R 12/58 439/876
4,057,315 A * 11/1977 Miller ..... H01R 12/58 439/869
4,186,982 A * 2/1980 Cobaugh ..... H01R 12/58 439/444
4,223,970 A * 9/1980 Walter ..... H01R 12/58 439/82
4,379,611 A * 4/1983 Foege ..... H01R 12/58 439/747
4,415,220 A * 11/1983 Kant ..... H01R 12/585 439/751
4,446,505 A * 5/1984 Long ..... H01R 12/585 361/784
4,464,007 A * 8/1984 Parmer ..... H01R 12/585 439/389
4,469,394 A * 9/1984 Verhoeven ..... H01R 12/58 439/873
4,585,293 A * 4/1986 Czeschka ..... H01R 12/58 439/751
4,586,778 A * 5/1986 Walter ..... H01R 12/585 439/751
4,655,537 A * 4/1987 Andrews, Jr. ..... H01R 12/585 439/751
4,691,979 A * 9/1987 Manska ..... H01R 12/585 439/82
4,698,026 A * 10/1987 Rolf ..... H01R 12/58 439/751
4,728,164 A * 3/1988 Lemmens ..... H01R 12/585 439/82
4,733,465 A * 3/1988 Tanaka ..... H01R 43/16 29/874
4,746,301 A * 5/1988 Key ..... H01R 12/58 439/751
4,758,187 A * 7/1988 Guglhor ..... H01R 12/585 439/741
4,762,498 A * 8/1988 Harting ..... H01R 12/58 439/751
4,768,980 A * 9/1988 Collier ..... H01R 12/585 439/751
4,769,907 A * 9/1988 Sebastien ..... H01R 12/585 29/874
4,784,620 A * 11/1988 Tanaka ..... H01R 43/16 439/751
4,793,817 A * 12/1988 Hiesbock ..... H01R 12/585 439/751
4,795,378 A * 1/1989 Tomizu ..... H01R 12/585 439/751
4,832,622 A * 5/1989 Zahn ..... B29C 45/0003 29/874
4,836,806 A * 6/1989 Dougherty ..... H01R 12/585 439/751
4,867,710 A * 9/1989 Harting ..... H01R 12/585 439/751
4,877,176 A * 10/1989 Kubis ..... H01R 12/585 228/173.5
4,878,861 A * 11/1989 Kendall ..... H01R 12/585 439/751
4,907,988 A * 3/1990 Tilse ..... H01R 12/58 439/751
4,923,414 A * 5/1990 Sitzler ..... H01R 12/585 439/751
4,936,797 A * 6/1990 Wehrle ..... H01R 12/58 439/751
5,035,656 A * 7/1991 Patel ..... H01R 12/58 439/733.1
5,094,633 A * 3/1992 Arai ..... H01R 12/585 29/845
5,139,446 A * 8/1992 Costello ..... H01R 13/42 439/751
5,487,684 A * 1/1996 Schalk ..... H01R 12/585 439/751
5,564,954 A * 10/1996 Wurster ..... H01R 12/585 439/751
5,573,431 A * 11/1996 Wurster ..... H01R 12/585 439/751
5,575,666 A * 11/1996 Dent ..... H01R 12/585 439/751
5,667,412 A * 9/1997 Takahashi ..... H01R 12/585 439/751
5,738,550 A * 4/1998 Sakuraoka ..... H01R 12/585 439/751
5,893,779 A * 4/1999 Bianca ..... H01R 12/585 439/751
5,897,401 A * 4/1999 Fili ..... H01R 13/41 411/451.1
5,921,788 A * 7/1999 Wilson ..... H01R 13/41 439/733.1
5,989,075 A * 11/1999 Hsiao ..... H01R 13/41 439/444
6,011,222 A * 1/2000 Sekiya ..... H01R 12/58 174/265
6,015,316 A * 1/2000 Matsubara ..... H01R 13/405 439/736
6,042,429 A * 3/2000 Bianca ..... H01R 13/41 439/733.1
6,052,895 A * 4/2000 Bianca ..... H01R 12/585 29/832
6,077,128 A * 6/2000 Maag ..... H01R 12/585 439/751
6,098,281 A * 8/2000 Rudi ..... H01R 12/585 29/837
6,149,471 A * 11/2000 Kemp ..... H01R 13/41 439/444
6,152,782 A * 11/2000 Volkert ..... H01R 13/41 439/733.1
6,190,214 B1 * 2/2001 Bianca ..... H01R 12/585 29/874
6,229,101 B1 * 5/2001 Sekiya ..... H01R 12/58 174/265
6,231,402 B1 * 5/2001 Kikuchi ..... H01R 12/585 439/751
6,305,949 B1 * 10/2001 Okuyama ..... H01R 12/585 439/75
6,309,228 B2 * 10/2001 Otsuki ..... H01R 12/585 439/751
6,309,259 B1 * 10/2001 Yamashita ..... H01R 12/585 439/439
6,328,576 B1 * 12/2001 Takahashi ..... H01R 13/41 439/733.1
6,354,849 B1 * 3/2002 Jones ..... H01R 12/585 439/82
6,565,392 B2 * 5/2003 Padro ..... H01R 13/428 439/751
6,722,928 B1 * 4/2004 Noda ..... H01R 12/585 439/751
6,875,032 B2 * 4/2005 Tsuchiya ..... H01R 12/585 439/751
6,896,559 B2 * 5/2005 Klein ..... H01R 13/04 439/733.1
6,984,135 B2 * 1/2006 Kaneko ..... H01R 12/585 439/82
6,997,757 B2 * 2/2006 Roshardt ..... H01R 43/0235 439/751
7,008,272 B2 * 3/2006 Blossfeld ..... H01R 12/585 439/751

(56) References Cited

U.S. PATENT DOCUMENTS 7,074,094 B2 * 7/2006 Kawahara ..... H01R 12/585 439/733.1
7,083,478 B1 * 8/2006 Kutsuna ..... H01R 13/41 439/733.1
7,175,480 B2 * 2/2007 Yamashita ..... H01R 13/41 439/733.1
7,214,021 B2 * 5/2007 Caponi ..... F16B 2/005 403/298
7,240,427 B2 * 7/2007 Ocket ..... H01R 12/585 29/842
7,249,981 B2 * 7/2007 Chen ..... H01R 12/585 439/751
7,255,612 B2 * 8/2007 Noguchi ..... H01R 12/585 439/751
D551,623 S * 9/2007 Lee ..... D13/133
7,377,823 B2 * 5/2008 Chen ..... H01R 12/585 439/751
7,445,499 B2 * 11/2008 Nunokawa ..... H01R 12/585 439/567
7,448,918 B2 * 11/2008 Lappoehn ..... H01R 13/41 439/660
7,708,605 B2 * 5/2010 Shibata ..... H01R 13/41 439/733.1
7,780,483 B1 * 8/2010 Ravlich ..... H01R 12/585 439/751
8,002,559 B2 * 8/2011 Thiel ..... H01R 12/585 439/751
8,210,856 B2 * 7/2012 Suzuki ..... H01R 12/585 439/733.1
8,317,551 B2 * 11/2012 Aboulkassem ..... H01R 13/17 439/825
8,556,641 B2 * 10/2013 Wilinski ..... H01R 31/085 439/75
8,702,454 B2 * 4/2014 Hamada ..... H01R 13/04 439/733.1
8,727,814 B2 * 5/2014 Fedder ..... H01R 12/585 439/751
8,747,124 B2 * 6/2014 Trout ..... H01R 4/26 439/751
8,771,028 B2 * 7/2014 Tonosaki ..... H01R 13/03 439/151
8,992,235 B2 * 3/2015 Kataoka ..... H01R 12/585 439/751
9,093,780 B2 * 7/2015 Miyake ..... H01R 12/585
9,118,136 B2 * 8/2015 Liu ..... H01R 13/41
9,172,166 B2 * 10/2015 Kida ..... H01R 13/41
9,265,150 B2 * 2/2016 Fox ..... H05K 1/18
9,300,059 B2 * 3/2016 Endo ..... H01R 4/48
9,419,364 B2 * 8/2016 Devos ..... H01R 13/41
9,431,719 B2 * 8/2016 Braunger ..... H01R 12/58
9,431,733 B1 * 8/2016 Heistand ..... H01R 43/16
9,515,407 B2 * 12/2016 Ohyama ..... H01R 13/41
9,537,278 B2 * 1/2017 Kawagishi ..... H01R 13/41
9,559,451 B2 * 1/2017 Uchida ..... H01R 12/585
9,570,832 B2 * 2/2017 Chew ..... H01R 13/415
9,583,858 B2 * 2/2017 Hashimoto ..... H01R 13/41
9,595,782 B2 * 3/2017 Farole ..... H01R 13/41
9,685,719 B2 * 6/2017 Uchida ..... H01R 12/585
9,728,869 B2 * 8/2017 Goto ..... H01R 12/58
9,728,928 B2 * 8/2017 Yoshigi ..... H01R 43/005
9,876,303 B2 * 1/2018 Suemitsu ..... H01R 13/41
2001/0021610 A1 * 9/2001 Otsuki ..... H01R 12/585 439/751
2001/0046817 A1 * 11/2001 Putnam ..... H01R 12/585 439/751
2003/0064632 A1 * 4/2003 Padro ..... H01R 13/428 439/751
2003/0064633 A1 * 4/2003 Padro ..... H01R 13/428 439/752
2003/0124886 A1 * 7/2003 Reisdorf ..... H01R 13/05 439/82
2003/0236009 A1 * 12/2003 Tsuchiya ..... H01R 12/585 439/82
2004/0145880 A1 7/2004 Watanabe et al.
2004/0203293 A1 * 10/2004 Hu ..... H01R 12/585 439/751
2004/0219841 A1 * 11/2004 Yamashita ..... H01R 13/41 439/733.1
2004/0242033 A1 * 12/2004 Hu ..... H01R 12/585 439/82
2004/0242082 A1 * 12/2004 Tsuchiya ..... H01R 12/585 439/751
2005/0003704 A1 * 1/2005 Kasahara ..... H01R 12/707 439/567
2005/0090155 A1 * 4/2005 Blossfeld ..... H01R 12/585 439/751
2005/0181651 A1 * 8/2005 Matsumura ..... H01R 12/585 439/259
2005/0250356 A1 * 11/2005 Matsumura ..... H01R 12/585 439/82
2005/0277312 A1 * 12/2005 Nakamura ..... H01R 12/585 439/82
2006/0035535 A1 * 2/2006 Kawahara ..... H01R 12/585 439/751
2006/0166526 A1 * 7/2006 Lee ..... H05K 3/368 439/75
2006/0216970 A1 * 9/2006 Pavlovic ..... H01R 13/41 439/83
2007/0010139 A1 * 1/2007 Chen ..... H01R 12/585 439/751
2007/0212907 A1 * 9/2007 Kramski ..... H01R 12/585 439/82
2008/0050947 A1 * 2/2008 Nunokawa ..... H01R 12/585 439/82
2008/0227315 A1 * 9/2008 Banno ..... H01R 12/58 439/82
2008/0318453 A1 * 12/2008 Dancison ..... H01R 12/585 439/82
2009/0117755 A1 * 5/2009 Tonosaki ..... H01R 13/41 439/55
2009/0221192 A1 * 9/2009 Fedder ..... H01R 12/585 439/751
2010/0136852 A1 * 6/2010 Mito ..... H01R 13/41 439/733.1
2011/0051389 A1 * 3/2011 Goto ..... H01R 12/58 361/803
2011/0201237 A1 * 8/2011 Suzuki ..... H01R 12/585 439/884
2012/0297852 A1 * 11/2012 Sakamoto ..... H01R 43/16 72/339
2013/0034976 A1 * 2/2013 Tonosaki ..... H01R 12/585 439/84
2013/0165001 A1 * 6/2013 Kataoka ..... H01R 13/05 439/889
2014/0213080 A1 * 7/2014 Miyake ..... H01R 12/585 439/82
2014/0342619 A1 * 11/2014 Uchida ..... H01R 12/585 439/751
2016/0020544 A1 * 1/2016 Ohyama ..... H01R 13/41 439/751
2016/0233603 A1 * 8/2016 Kawagishi ..... H01R 13/41
2016/0359257 A1 * 12/2016 Chiba ..... H01R 12/724

FOREIGN PATENT DOCUMENTS

JP H11-297385 A 10/1999
JP 2004-127610 A 4/2004
JP 2010-262863 A 11/2010
JP 2013-149578 A 8/2013
JP 2014-149956 A 8/2014

* cited by examiner

PRESS-FIT TERMINAL

CROSS-REFERENCE TO RELATED APPLICATIONS

This application is the U.S. national stage of PCT/JP2016/057355 filed Mar. 9, 2016, which claims priority of Japanese Patent Application No. JP 2015-087643 filed Apr. 22, 2015.

TECHNICAL FIELD

The present invention relates to a press-fit terminal that is press fitted into a through hole of a printed board, and is thus electrically connected to a conductor applied to an inner surface of the through hole.

BACKGROUND

Conventionally, a connection terminal is used to electrically connect a circuit conductor provided on a board such as a printed board, to a partner member such as a connector. A so-called press-fit terminal, which is disclosed in JP 2004-127610A, for example, is known as such a connection terminal. In such a press-fit terminal, one end portion of a rod-shaped metal member is provided with a press-contact portion that is springy, whereas the other end portion of the rod-shaped metal member is provided with a connection portion that is to be connected to a partner member. The press-contact portion is press-fitted into, and is fixed to, a through hole of a board. Thus, it is possible to electrically connect the press-fit terminal to a conductor that is exposed in the through hole, and fix the press-fit terminal to the board, without using a solder.

As discussed in JP 2004-127610A, press-fit terminals are formed by stamping a metal plate. Then, a pair of arch-shaped press-contact portions are formed by punching a through hole in a central area of one end portion of a rod-shaped metal member. Such a pair of press-contact portions are formed so as to be elastically deformable in a direction that is orthogonal to the axis, and thus the rod-shaped metal member is provided with springiness.

However, many connection terminals are extremely small and have a width or a plate thickness of less than 1 mm. It is difficult to process such a terminal to form press-contact portions that have the above-described structure, and this is a cause of an increase in manufacturing costs. In addition, since both ends of each arch-shaped press-contact portion are connected to the terminal, it is difficult to secure a sufficient amount of warp. Therefore, it is inevitable that a strong insertion force is applied when the press-contact portions are inserted into the through hole, and there is also the risk of the press-contact portions shaving the inner surface of the through hole and producing metal shavings.

Considering the problems above, the inventor of the present invention previously proposed in JP 2013-149578A a press-fit terminal that includes a rod-shaped metal member, which is longitudinally rod-shaped, and press-contact portions that are formed by bringing a metal material, which is separate from the rod-shaped metal member, into press-contact with the rod-shaped metal member such that the metal material wraps around one end portion of the rod-shaped metal member. With this configuration, the rod-shaped metal member and the press-contact portions are formed using separate components, and therefore flexibility improves when manufacturing press-contact portions, and it becomes possible to advantageously form press-contact portions that have sufficient springiness (amount of warp) even if the plate thickness of the rod-shaped metal member is small. Therefore, it is possible to reliably bring the press-contact portion into press-contact with a through hole while reducing the insertion force that is applied when the press-contact portions are inserted into the through hole. Also, it is possible to prevent the problem in which the press-contact portions shave the inner surface of the through hole.

However, since the press-contact portions are formed by bringing a metal material, which is separate from the rod-shaped metal member, into press-contact with the rod-shaped metal member such that the metal material wraps around one end portion of the rod-shaped metal member, there is still room for improvement in terms of suppressing an increase in the number of components and manufacturing costs, and further improved press-fit terminals have been developed.

The present invention has been made in view of the above-described situation, and a problem to be solved by the invention is to provide a press-fit terminal that has a novel structure that makes it possible to secure an amount of warp of press-contact portions and reduce insertion force that is applied when the press-contact portions are inserted into the through hole, while suppressing an increase in the number of components and manufacturing costs.

SUMMARY

A first aspect of the present invention is a press-fit terminal in which one end portion of a rod-shaped metal member is provided with press-contact portions that are to be press-fitted into a through hole of a printed board and electrically connected to a conductor on an inner surface of the through hole, and the other end portion of the rod-shaped metal member is provided with a connection portion that is to be connected to a partner member, wherein the one end portion of the rod-shaped metal member has: squashed portions that are provided by performing press-forging on portions of a surface of the one end portion; and the press-contact portions that are formed as portions that protrude outward in a domed shape due to the squashed portions being provided, each press-contact portion is configured to deform to warp in a circumferential direction of the rod-shaped metal member due to contact pressure that is applied when the press-contact portions are pressed against the through hole, and a depth of each squashed portion gradually decreases toward both ends of the rod-shaped metal member in an axial direction, and a length of a protrusion of each press-contact portion decreases toward both ends of the rod-shaped metal member in the axial direction.

According to this aspect, the press-contact portions are formed as portions that protrude outward due to the squashed portions being provided by performing press-forging on portions of a surface of the one end portion of the rod-shaped metal member. Therefore, it is unnecessary to form the press-contact portions using a conventional metal member that is separate from the rod-shaped metal member, and hence it is possible to reduce the number of components and manufacturing costs. In particular, since it is possible to form the press-contact portions by simply performing press-forging to provide the squashed portions, it is easier to perform processing compared to the case of forming a through hole, even if the required width of the press-fit terminal is small. Therefore, it is possible to suppress an increase in manufacturing costs or the like. Furthermore, according to this aspect, the depth of the squashed portions is largest at a central portion of the rod-shaped metal member in the axial direction, and gradually decrease toward both sides. Therefore, the protruding length of the press-contact portions that protrude outward due to the squashed portions being provided also gradually decreases towards both ends in the axial direction, and thus the outer surfaces of the protruding portions are formed so as to have a tapered shape. Therefore, it is possible to smoothly perform an operation to insert the press-fit terminal into the through hole, and thus it is possible to improve workability at the time of insertion.

Also, the press-contact portions protrude outward in a cantilever-like shape from the surface of the rod-shaped metal member, and when press-fitted into the through hole, the press-contact portions deform to warp in the circumferential direction of the rod-shaped metal member due to contact pressure. Therefore, it is easier to secure a sufficient amount of warp, and hence it is possible to reduce the insertion force that is applied when the press-contact portions are inserted into the through hole, while securing desired springiness.

Moreover, since the press-contact portions deform to warp in the circumferential direction of the rod-shaped metal member when press-fitted into the through hole, compressing stresses of the contact portions are prevented from interfering with each other in a direction that is orthogonal to the axial direction of the rod-shaped metal member, and it is possible to more reliably reduce the insertion force.

A second aspect of the present invention is the press-fit terminal according to the first aspect, wherein the rod-shaped metal member is formed by cutting a rectangular metal wire to a predetermined length, a plating layer is applied to a surface of the rectangular metal wire, a pair of squashed portions are provided as the squashed portions in at least one pair of opposing surfaces of the rod-shaped metal member, and a pair of press-contact portions are provided as the press-contact portions at at least one pair of diagonal positions of the rod-shaped metal member.

According to this aspect, it is possible to easily form the rod-shaped metal member by cutting a rectangular metal wire. Also, it is possible to stably form the squashed portions by performing press-forging on the pair of opposing surfaces of the rectangular metal wire from both sides. Furthermore, since the press-contact portions are provided on the pair of corner portions, the press-contact portions protrude outward in an advantageous manner. Therefore, it is possible to advantageously form the press-fit terminal according to the present aspect, while reducing manufacturing costs.

Moreover, since plating has been applied to the surface of the rectangular metal wire in advance, it is unnecessary to perform post-plating processing on the press-contact portions, unlike in the case of conventional stamping processing. Therefore, it is possible to further reduce costs.

A third aspect of the present invention is the press-fit terminal according to the first or second aspect, wherein, in a cross section along a direction that is orthogonal to an axial direction of the rod-shaped metal member, each squashed portion includes a first oblique side and a second oblique side that is longer than the first oblique side.

According to this aspect, since the first oblique side and the second oblique side of each squashed portion have different lengths, it is possible that central axes that extend in protruding directions of the press-contact portions that protrude outward due to the squashed portions do not intersect the central axis of the rod-shaped metal member. With this configuration, when the press-contact portions are press-fitted into the through hole, force components that press the press-contact portions in the circumferential direction are generated, which allow the press-contact portions to deform to warp in the circumferential direction.

A fifth aspect of the present invention is the press-fit terminal according to any one of the first to fourth aspects, wherein the rod-shaped metal member has a rectangular cross section, the squashed portions are provided by performing press-forging on two pairs of opposing surfaces of the rod-shaped metal member, and the press-contact portions that protrude outward and are each configured to deform to warp in the circumferential direction of the rod-shaped metal member are formed at both pairs of diagonal positions of the rod-shaped metal member due to the squashed portions being provided.

According to this aspect, since the squashed portions are provided by performing press-forging on two pairs of opposing surfaces of the rod-shaped metal member that has a rectangular cross section, it is possible to easily provide four press-contact portions that are each configured to deform to warp in the circumferential direction of the rod-shaped metal member, on the four corner portions of the rod-shaped metal member. With this configuration, the press-fit terminal is pressed into and fixed to the through hole using the four press-contact portions that are separated from each other in the circumferential direction. Therefore, it is possible to more reliably bring the press-contact portions into press-contact with the through hole, and it is possible to further reduce the insertion force that is applied when the press-contact portions are inserted into the through hole.

A sixth aspect of the present invention is the press-fit terminal according to the second aspect, wherein the rectangular metal wire is made of a copper alloy.

According to this aspect, the rectangular metal wire is made of a copper alloy. With this configuration, it is possible to advantageously form the press-contact portions that are configured to deform to warp in the circumferential direction of the rod-shaped metal member. Note that examples of the copper alloy include phosphor bronze and C194, which have excellent springiness.

Advantageous Effects

According to the present invention, the press-contact portions are formed as portions that protrude outward by providing the squashed portions. Therefore, it is unnecessary to form the press-contact portions using a conventional metal member that is separate from the rod-shaped metal member, and hence it is possible to reduce the number of components and manufacturing costs. Also, it is easier to perform processing compared to the case of forming a through hole, even if the required width of the press-fit terminal is small. Therefore, it is possible to suppress an increase in manufacturing costs or the like. Furthermore, the press-contact portions protrude outward in a cantilever-like shape from the surface of the rod-shaped metal member, and when press-fitted into the through hole, the press-contact portions deform to warp in the circumferential direction of the rod-shaped metal member due to contact pressure. Therefore, it is easier to secure a sufficient amount of warp, and hence it is possible to reduce the insertion force that is applied when the press-contact portions are inserted into the through hole, while securing desired springiness. Moreover, since the press-contact portions deform to warp in the circumferential direction of the rod-shaped metal member, compressing stresses of the contact portions are prevented from interfering with each other in a direction that is orthogonal to the axial direction of the rod-shaped metal member, and it is possible to more reliably reduce the insertion force.

DETAILED DESCRIPTION OF PREFERRED EMBODIMENTS

The following describes embodiments of the present invention with reference to the drawings.

Figure 1:
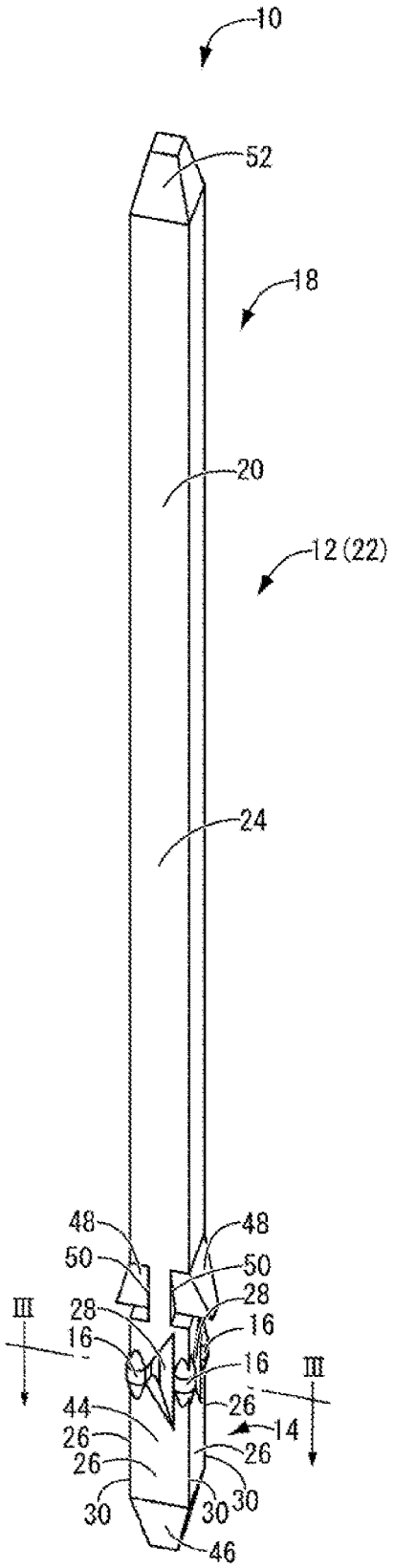
FIG. 1 is a perspective view showing a press-fit terminal, which is a first embodiment of the present invention.
Figure 2:
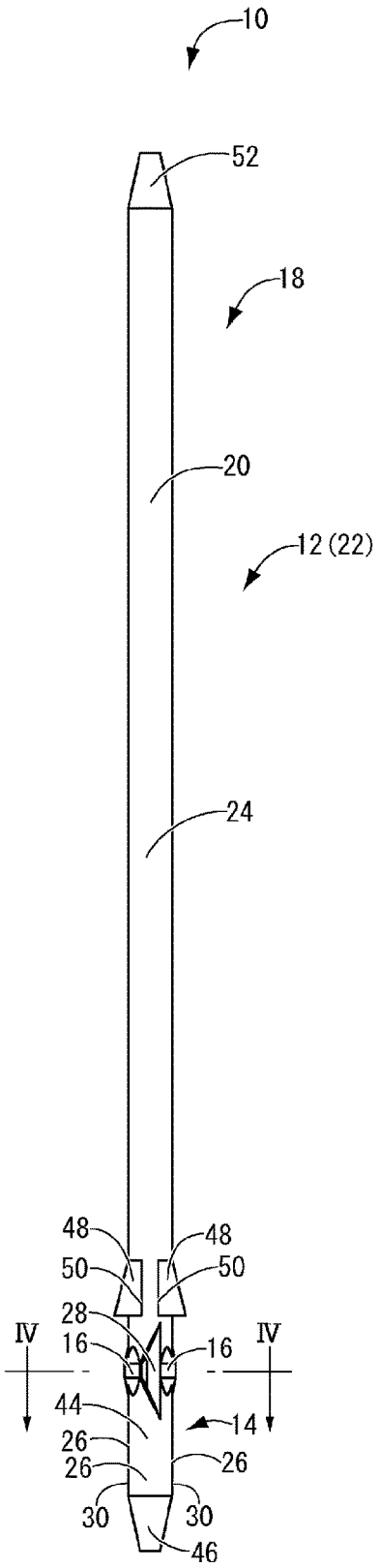
FIG. 2 is a front view of FIG. 1.

First, FIGS. 1 and 2 show a press-fit terminal 10, which is a first embodiment of the present invention. The press-fit terminal 10 is an integrally molded part in which press-contact portions 16 are formed in one end portion 14 of a rod-shaped metal member 12, and a connection portion 20 is formed in the other end portion 18 of the rod-shaped metal member 12. Note that, in the following description, "lengthwise direction" and "top-bottom direction" refer to the top-bottom direction in FIG. 2, and "widthwise direction" refers to the left-right direction in FIG. 2. Also, "plate-thickness direction" refers to a direction that is orthogonal to the drawing sheet of FIG. 2.

The rod-shaped metal member 12 is formed by cutting a rectangular metal wire 22 to a predetermined length. Preferably, a rectangular metal wire that is rigid enough to undergo shape processing to impart springiness is employed as the rectangular metal wire 22. For example, the rectangular metal wire 22 is a wire that is made of a copper alloy with excellent springiness, such as phosphor bronze or C194, and extends with a constant cross section that has a substantially square shape. A plating layer 24 is applied to the entire circumferential surface of the rectangular metal wire 22. The plating layer 24 is formed by, for example, laminating tin plating or the like on base plating of copper, nickel, or the like.

The press-contact portions 16 are formed in the one end portion 14 of the rod-shaped metal member 12 that has been cut out of such a rectangular metal wire 22. The press-contact portions 16 are formed as portions that protrude outward from both pairs of diagonal positions, namely, four corner portions 30 of the rod-shaped metal member 12 due to squashed portions 28 being formed by pressure-forging the two pairs of opposing surfaces 26 of the rod-shaped metal member 12 that has a substantially square cross-sectional shape.

Figure 3A:
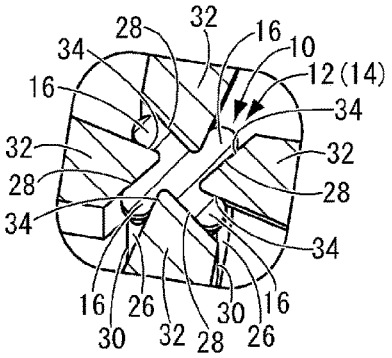
FIG. 3 is an enlarged perspective view of a main part of a cross section along III-III in FIG. 1, and illustrates a manufacturing method according to the present embodiment ((a) at the time of punching, (b) after punching).
Figure 3B:
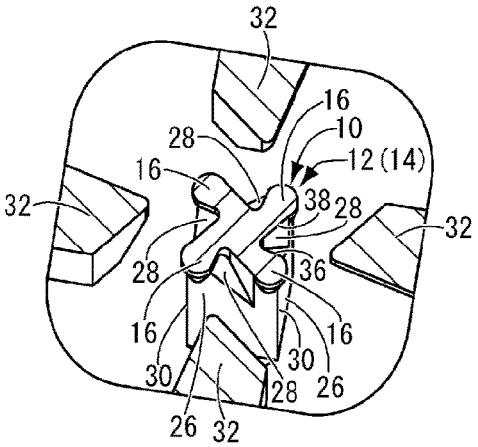
Figure 4A:
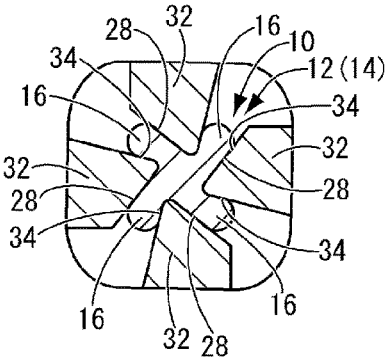
FIG. 4 is an enlarged view of a main part of a cross section along IV-IV in FIG. 2, and illustrates a manufacturing method according to the present embodiment ((a) at the time of punching, (b) after punching).
Figure 4B:
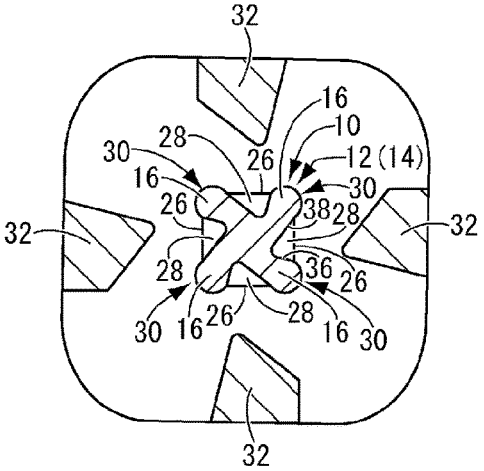

As shown in FIGS. 3 and 4, which illustrate cross sections along a direction that is orthogonal to the axial direction of the rod-shaped metal member 12, the press-contact portions 16 are formed by simultaneously pressing four punches (dies) 32 that have the same shape, against the two pairs of opposing surfaces 26, namely four opposing surfaces 26 of the one end portion 14 of the rod-shaped metal member 12 that has a substantially square cross-sectional shape, to perform press-forging on the four opposing surfaces 26. More specifically, as shown in FIGS. 3(*a*) and 4(*a*), portions that have been pushed away to the sides of the punches 32 due to the punches 32 being pressed against the four opposing surfaces 26 of the rod-shaped metal member 12, are pushed out to gaps 34 between adjacent punches 32, and thus the press-contact portions 16 are formed. Also, the punches 32 are asymmetric with respect to directions in which the punches 32 are pressed against the opposing surfaces 26 of the rod-shaped metal member 12, and therefore the squashed portions 28 each include a first oblique side 36 and a second oblique side 38 that is longer than the first oblique side 36 (see FIGS. 3(*b*) and 4(*b*)). Furthermore, as shown in FIGS. 1 and 2, the squashed portions 28 are recessed portions that each have a substantially triangular pyramid shape, and the depth of each squashed portion 28 gradually decreases toward both ends of the rod-shaped metal member 12 in the axial direction (the top-bottom direction). In contrast, the press-contact portions 16 are protruding portions that each have a substantially domed shape, and the length of the protrusion of each press-contact portion 16 gradually decreases toward both ends of the rod-shaped metal member 12 in the axial direction (the top-bottom direction).

In the one end portion 14 of the rod-shaped metal member 12, a portion that is closer to the front side (the lower side in FIGS. 1 and 2) than the press-contact portions 16 is provided with an insertion portion 44 that protrudes downward. Also, as in conventional terminals, a front end tapered portion 46, which is tapered, is formed at an edge portion of the insertion portion 44.

Also, in the rod-shaped metal member 12, a portion that is closer to the center side (the upper side in FIG. 2) than the press-contact portions 16 in the lengthwise direction (the top-bottom direction in FIG. 2) is provided with a pair of board contact portions 48. The pair of board contact portions 48 have a configuration in which both side portions in the widthwise direction, which are closer to the center, are partially cut apart from a central portion in the widthwise direction, which is closer to the center, due to a pair of slits 50 being provided in the thickness direction so as to extend in a substantially L-like shape, with the upper edges of the side portions being coupled to the connection portion 20. The pair of board contact portions 48 are formed by bending up the lower edges of both widthwise side portions so as to protrude in the opposite directions in the plate thickness direction.

Furthermore, the connection portion 20 is formed in the other end portion 18 of the rod-shaped metal member 12. Also, as in conventional terminals, a rear end tapered portion 52, which is tapered, is formed at an edge portion of the connection portion 20.

Figure 5:
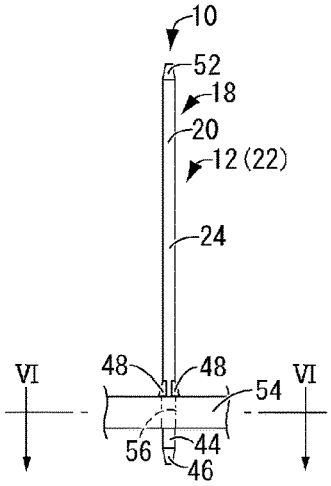
FIG. 5 is a front view showing a situation where the press-fit terminal according to the present embodiment is provided so as to stand on a printed board.
Figure 6:
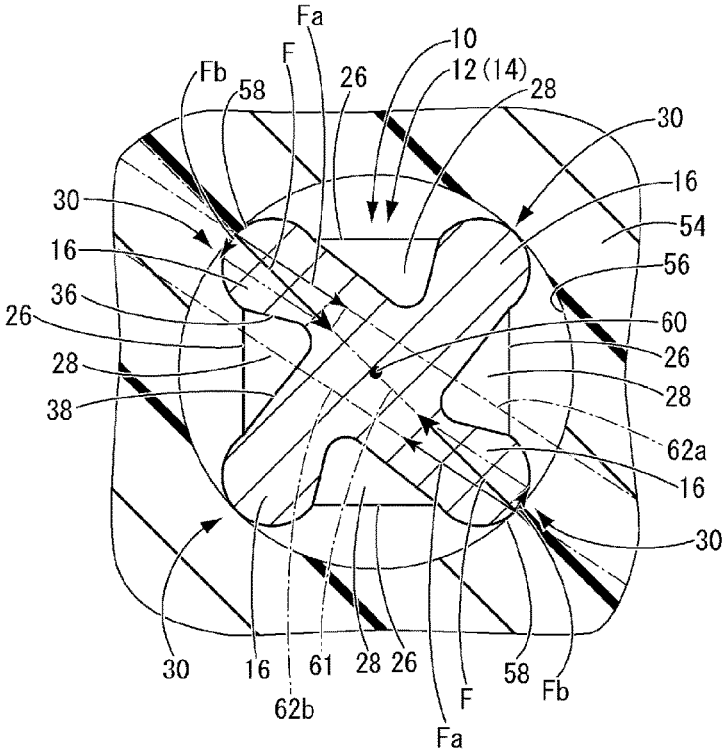
FIG. 6 is an enlarged view of a main part of a cross section along VI-VI in FIG. 5.

The press-fit terminal 10 with such a configuration is inserted into a through hole 56 of a printed board 54 from the insertion portion 44 as shown in FIG. 5. Here, the amount of insertion of the press-fit terminal 10 into the through hole 56 is determined by the board contact portions 48 abutting against the printed board 54. Thus, the press-contact portions 16 are press-fitted into the through hole 56, and, as shown in FIG. 6, end surfaces 58 of the press-contact portions 16 are pressed toward a central axis 60 of the rod-shaped metal member 12 in a direction along a pressing axis 61 due to contact pressure that is applied when the press-contact portions 16 are pressed against the through hole 56 at the time of such press-fitting. Since the first oblique side 36 and the second oblique side 38 of each squashed portion 28 have different lengths, central axes 62*a* and 62*b*, which extend in protruding directions of the press-contact portions 16 that protrude outward due to the squashed portions 28, do not intersect the central axis 60 of the rod-shaped metal member 12. With this configuration, pressing forces F that are applied to the end surfaces 58 of the press-contact portions 16 as a result of the above-described press-fitting can be divided into, as shown in FIG. 6, compressing forces Fa that compress the press-contact portions 16 in the directions along the central axes 62*a* and 62*b* and rotational forces Fb that press the press-contact portions 16 in a circumferential direction (the counterclockwise direction in FIG. 6). Due to rotational forces Fb, the press-contact portions 16 deform to warp in the circumferential direction of the rod-shaped metal member 12. As a result, due to the elastic restoring forces of the press-contact portions 16 in the directions along the central axes 62*a* and 62*b* and the circumferential direction, the end surfaces 58 of the press-contact portions 16 are brought into press-contact with the through hole plating layer (not shown) that is formed as a conductor on the inner surface of the through hole 56. As a result, the press-fit terminal 10 is fixed to the printed board 54 with the connection portion 20 protruding, the press-contact portions 16 are electrically connected to the through hole plating layer, and a partner member such as a connector (not shown) is connected to the connection portion 20. Note that the directions in which the compressing forces Fa are applied to each pair of press-contact portions 16 that are opposite with respect to the central axis 60 of the rod-shaped metal member 12 do not interfere with each other as indicated by the central axes 62*a* and 62*b* in FIG. 6, and therefore such a configuration contributes to a reduction in the insertion force.

In the press-fit terminal 10 with such a configuration, the press-contact portions 16 protrude from the corner portions 30 of the rod-shaped metal member 12 due to the squashed portions 28 being formed in the one end portion 14 of the rod-shaped metal member 12 by performing press-forging on the opposing surfaces 26 of the rod-shaped metal member 12. Therefore, it is unnecessary to form the press-contact portions 16 using a conventional metal member that is separate from the rod-shaped metal member 12, and hence it is possible to reduce the number of components and manufacturing costs. Moreover, since it is possible to form the press-contact portions 16 by simply forming the squashed portions 28 by performing press-forging on the opposing surfaces 26 of the rod-shaped metal member 12, it is easier to perform processing compared to the case of forming a conventional through hole, even if the required width of the press-fit terminal 10 is small. Therefore, it is possible to suppress an increase in manufacturing costs or the like.

In addition, according to the present embodiment, it is possible to easily form the rod-shaped metal member 12 by cutting the rectangular metal wire 22, and to stably form the squashed portions 28 by performing press-forging on each pair of opposing surfaces 26 of the rectangular metal wire 22 from both sides. Furthermore, since the press-contact portions 16 are provided on the corner portions 30, the press-contact portions 16 protrude outward in an advantageous manner. Moreover, since the plating layer 24 is applied to the surface of the rectangular metal wire 22, it is unnecessary to perform post-plating processing on the press-contact portions 16, unlike in the case of conventional stamping processing. Therefore, it is possible to further reduce costs.

The press-contact portions 16 protrude outward in a cantilever-like shape from the surface of the rod-shaped metal member 12, and when press-fitted into the through hole 56, the press-contact portions 16 deform to warp in the circumferential direction of the rod-shaped metal member 12 due to contact pressure. Therefore, it is easier to secure a sufficient amount of warp of the press-contact portions 16, and hence it is possible to reduce the insertion force that is applied when the press-contact portions 16 are inserted into the through hole 56, while securing desired springiness. Moreover, using the rod-shaped metal member 12 that has been cut out of the rectangular metal wire 22 that has a substantially square cross-sectional shape, it is possible to easily provide the four corner portions 30 of the rod-shaped metal member 12 with the four press-contact portions 16 that can deform to warp in the circumferential direction of the rod-shaped metal member 12 by performing press-forging on the opposing surfaces 26 to form the squashed portions 28. Therefore, it is possible to more reliably bring the press-contact portions 16 into press-contact with the through hole 56, and it is possible to further reduce the insertion force that is applied when the press-contact portions 16 are inserted into the through hole 56.

Furthermore, since the depth of the squashed portions 28 gradually decreases toward both ends of the rod-shaped metal member 12 in the axial direction (the top-bottom direction), the press-contact portions 16, which protrude outward due to the squashed portions 28 being formed, are realized as substantially domed protrusions whose protruding length gradually decreases toward both ends in the axial direction. Therefore, it is possible to smoothly perform an operation to insert the press-fit terminal 10 into the through hole 56, and thus it is possible to improve workability at the time of insertion.

Next, a press-fit terminal 64, which is a second embodiment of the present invention, will be described in detail with reference to FIGS. 7 to 10. In these drawings, members and portions that have the same configurations as those in the above-described embodiment are assigned the same reference numerals as those in the above-described embodiment, and detailed descriptions thereof are omitted. The press-fit terminal 64 is formed by stamping a metal plate that is made of, for example, a copper alloy with excellent springiness, such as phosphor bronze or C194, the surface of which is plated with tin or the like. The press-fit terminal 64 is an embodiment that is different from the first embodiment in that the press-fit terminal 64 is formed using a rod-shaped metal member 66 that has a substantially strip-like flat shape as a whole. That is, in the press-fit terminal 64 according to the present embodiment, press-contact portions 68 are formed in the one end portion 14 of the rod-shaped metal member 66 as portions that protrude outward from diagonal positions, namely, two corner portions 30 of the rod-shaped metal member 66 due to the squashed portions 28 being formed by pressure-forging a pair of opposing surfaces 26 that are opposite in the plate thickness direction (a direction that is orthogonal to the drawing sheet of FIG. 8). Therefore, as with the above-described first embodiment, it is unnecessary to form the press-contact portions 68 using a conventional metal member that is separate from the rod-shaped metal member 66, and hence it is possible to reduce the number of components and manufacturing costs.

Figure 10:
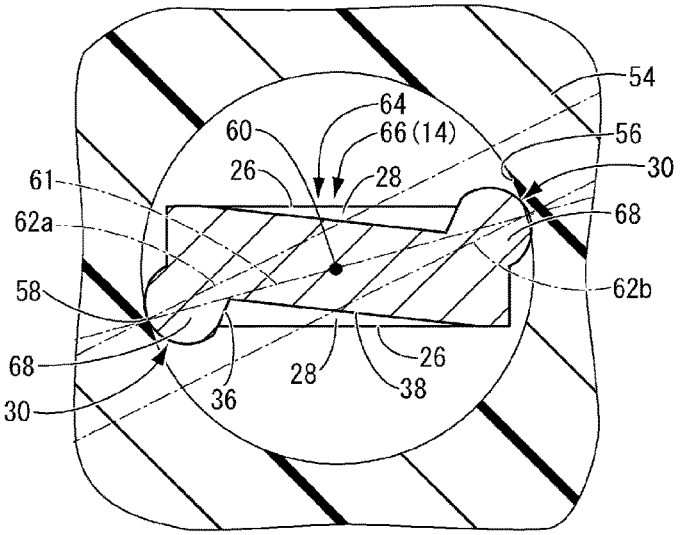
FIG. 10 is an enlarged view of a main part of a cross section along X-X in FIG. 9.

Also, in the press-fit terminal 64 according to the present embodiment, as shown in FIG. 10, the press-contact portions 68 are formed so as to protrude outward in a cantilever-like shape from the two corner portions 30 of the rod-shaped metal member 66. Moreover, in the press-contact portions 68, as in the above-described first embodiment, the first oblique side 36 and the second oblique side 38 of each squashed portion 28 have different lengths, and therefore the central axes 62*a* and 62*b*, which extend in protruding directions of the press-contact portions 68 do not intersect the central axis 60 of the rod-shaped metal member 66. As a result, when the press-contact portions 68 are press-fitted into the through hole 56, the press-contact portions 68 deform to warp in the circumferential direction of the rod-shaped metal member 66 due to the contact pressure. Therefore, as with the above-described first embodiment, it is easier to secure a sufficient amount of warp of the press-contact portions 68, and hence it is possible to reduce the insertion force that is applied when the press-contact portions 68 are inserted into the through hole 56, while securing desired springiness.

Figure 7:
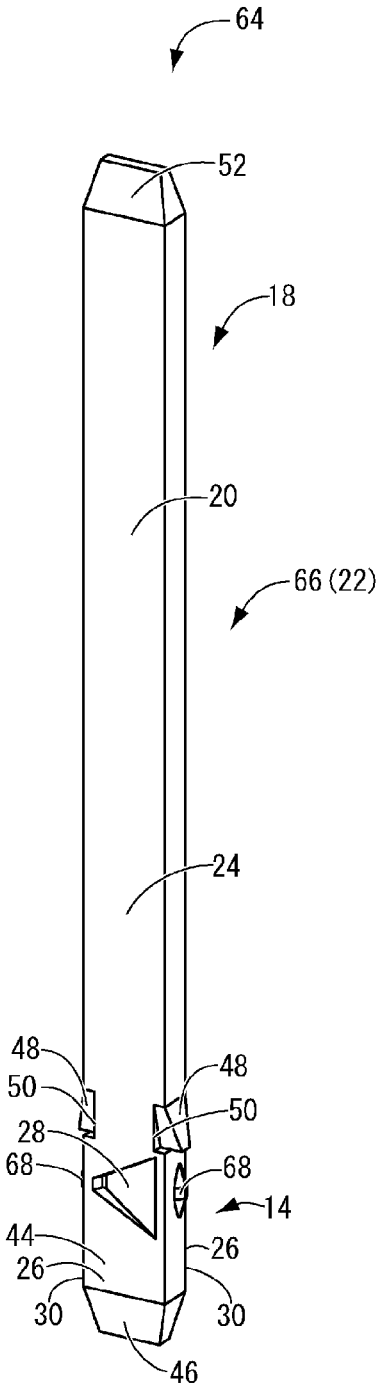
FIG. 7 is a perspective view showing a press-fit terminal, which is a second embodiment of the present invention.
Figure 8:
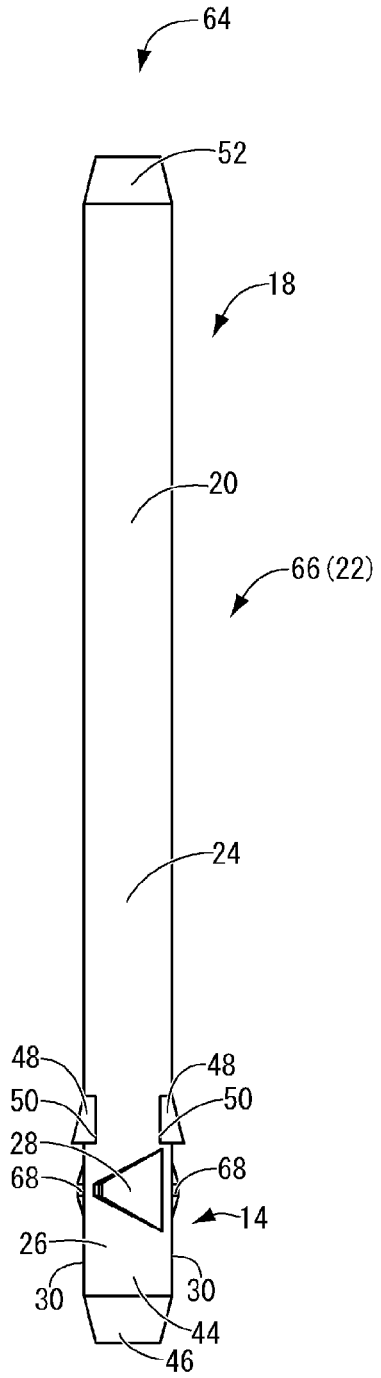
FIG. 8 is a front view of FIG. 7.
Figure 9:
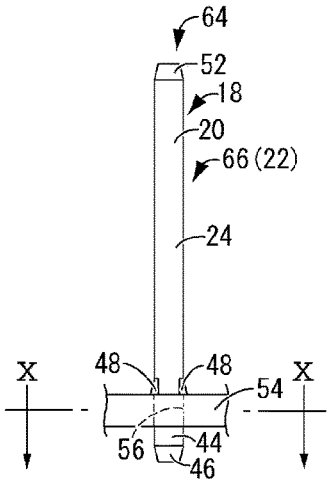
FIG. 9 is a front view showing a situation where the press-fit terminal according to the present embodiment is provided so as to stand on a printed board.

Furthermore, in the press-fit terminal 64 according to the present embodiment, as shown in FIG. 7, as in the above-described first embodiment, the depth of the squashed portions 28 gradually decreases toward both ends of the rod-shaped metal member 66 in the axial direction (the top-bottom direction), and therefore the press-contact portions 68, which protrude outward due to the squashed portions 28 being formed, are realized as substantially domed protrusions whose protruding length gradually decreases toward both ends in the axial direction. Therefore, as with the above-described first embodiment, it is possible to smoothly perform an operation to insert the press-fit terminal 64 into the through hole 56, and thus it is possible to improve workability at the time of insertion.

Although embodiments of the present invention have been described above, the present invention is not limited to the specific descriptions of the embodiments in any manner. For example, although the press-contact portions 16 in the above-described first embodiment are formed at both pairs of diagonal positions of the rod-shaped metal member 12 due to the squashed portions 28 being formed by pressure-forging the two pairs of opposing surfaces 26 of the rod-shaped metal member 12, the press-contact portions 16 may be formed at only one pair of diagonal positions of the rod-shaped metal member 12 due to the squashed portions 28 being formed by pressure-forging one pair of opposing surfaces 26 of the rod-shaped metal member 12.

Figure 11:
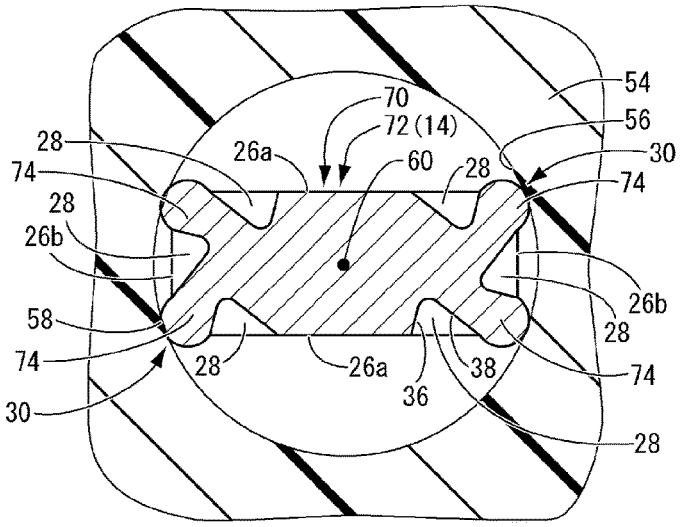
FIG. 11 is an enlarged cross-sectional view of a main part that shows a press-fit terminal, which is a third embodiment of the present invention, and corresponds to FIGS. 6 and 10.

Furthermore, as shown in FIG. 11, in a rod-shaped metal member 72, which has a substantially rectangular cross section, of a press-fit terminal 70, which is a third embodiment of the present invention, it is possible that, in each of a pair of wider opposing surfaces 26*a*, squashed portions 28 that have substantially the same shape as those in the first embodiment are provided in both end portions in the widthwise direction such that the squashed portions 28 are point-symmetric with respect to the central axis 60 of the rod-shaped metal member 72, whereas, in each of a pair of narrower opposing surfaces 26*b*, a squashed portion 28 that has substantially the same shape as those in the first embodiment is provided in a central portion such that the squashed portions 28 are point-symmetric with respect to the central axis 60 of the rod-shaped metal member 72. With such a configuration, it is possible to advantageously form elongated press-contact portions 74 that protrude from the four corner portions of the rod-shaped metal member 72 that has a substantially rectangular cross section, and it is possible to more advantageously secure the springiness of the press-contact portions 74.

The invention claimed is:

1. A press-fit terminal in which one end portion of a rod-shaped metal member is provided with press-contact portions that are to be press-fitted into a through hole of a printed board and electrically connected to a conductor on an inner surface of the through hole, and the other end portion of the rod-shaped metal member is provided with a connection portion that is to be connected to a partner member, wherein the one end portion of the rod-shaped metal member has: squashed portions that are provided by performing press-forging on portions of a surface of the one end portion; and the squashed portions defining press-contact portions that protrude outwardly from the rod-shaped metal member in a domed shape;

each press-contact portion is configured to deform to warp in a circumferential direction of the rod-shaped metal member due to contact pressure that is applied when the press-contact portions are pressed against the through hole, and a depth of each squashed portion gradually decreases toward both ends of the rod-shaped metal member in an axial direction so as to form the shape of a truncated triangular prism, and a length of a protrusion of each press-contact portion decreases toward both ends of the rod-shaped metal member in the axial direction so as to define a first and second tapered ends, and wherein, in a cross section along a direction that is orthogonal to an axial direction of the rod-shaped metal member, each squashed portion includes a first oblique side and a second oblique side that is longer than the first oblique side, the first and second oblique sides are angled relative to each other and an outer surface of the rod-shaped metal member.

2. The press-fit terminal according to claim 1, wherein the rod-shaped metal member is formed by cutting a rectangular metal wire to a predetermined length, a plating layer is applied to a surface of the rectangular metal wire, a pair of squashed portions are provided as the squashed portions in at least one pair of opposing surfaces of the rod-shaped metal member, and a pair of press-contact portions are provided as the press-contact portions at at least one pair of diagonal positions of the rod-shaped metal member.

3. The press-fit terminal according to claim 2, wherein the rectangular metal wire is made of a copper alloy.

4. The press-fit terminal according to claim 2, wherein the rod-shaped metal member has a rectangular cross section, the squashed portions are provided by performing press-forging on two pairs of opposing surfaces of the rod-shaped metal member, and the press-contact portions that protrude outward and are each configured to deform to warp in the circumferential direction of the rod-shaped metal member are formed at both pairs of diagonal positions of the rod-shaped metal member due to the squashed portions being provided.

5. The press-fit terminal according to claim 1, wherein the rod-shaped metal member has a rectangular cross section, the squashed portions are provided by performing press-forging on two pairs of opposing surfaces of the rod-shaped metal member, and the press-contact portions that protrude outward and are each configured to deform to warp in the circumferential direction of the rod-shaped metal member are formed at both pairs of diagonal positions of the rod-shaped metal member due to the squashed portions being provided.

* * * * *